US006776818B1

(12) United States Patent
Nilsson

(10) Patent No.: US 6,776,818 B1
(45) Date of Patent: Aug. 17, 2004

(54) PROJECTILE OF SINTERED METAL POWDER

(75) Inventor: Åke Nilsson, Arvika (SE)

(73) Assignee: Norma Precision AB, Amotfors (SE)

( * ) Notice: Subject to any disclaimer, the term of this patent is extended or adjusted under 35 U.S.C. 154(b) by 64 days.

(21) Appl. No.: 10/069,509

(22) PCT Filed: Aug. 10, 2000

(86) PCT No.: PCT/SE00/01565

§ 371 (c)(1),
(2), (4) Date: Mar. 4, 2002

(87) PCT Pub. No.: WO01/18453

PCT Pub. Date: Mar. 15, 2001

(30) Foreign Application Priority Data

Sep. 3, 1999 (SE) ..... 9903111

(51) Int. Cl.[7] ..... B22F 3/00; F42B 12/00

(52) U.S. Cl. ..... 75/228; 75/246; 102/517; 428/547; 428/550

(58) Field of Search ..... 75/228, 246; 102/517; 428/547, 550

(56) References Cited

U.S. PATENT DOCUMENTS

| | | | | | |
|---|---|---|---|---|---|
| 4,958,572 | A | * | 9/1990 | Martel | 102/529 |
| 5,442,989 | A | * | 8/1995 | Anderson | 86/20.12 |
| 5,852,256 | A | * | 12/1998 | Hornig | |
| 5,877,437 | A | | 3/1999 | Oltrogge | 75/228 |
| 5,950,064 | A | | 9/1999 | Robinson et al. | 419/47 |

FOREIGN PATENT DOCUMENTS

| | | |
|---|---|---|
| CA | 2231572 | 1/1998 |
| EP | 0 626 557 | 11/1994 |
| GB | 697172 | 9/1953 |
| WO | 00/02689 | 1/2000 |

* cited by examiner

*Primary Examiner*—Ngoclan T. Mai
(74) *Attorney, Agent, or Firm*—Jacobson Holman PLLC

(57) ABSTRACT

A projectile having a body of sintered metal powder and a sintered metal powder surface that faces toward the rifling in the bore of a firearm, and therewith co-acts with the rifling. At least the body layer that is deformed by the rifling has a porosity in the region of 5–25%. The powder may consist of a copper alloy, such as tombak.

12 Claims, 1 Drawing Sheet

PROJECTILE OF SINTERED METAL POWDER

This is a nationalization of PCT/SE00/01565 filed Aug. 10, 2000 and published in English.

BACKGROUND OF THE INVENTION

1. Field of the Invention

The invention relates to a projectile having a body of sintered metal powder.

2. Description of the Related Art

It is well known to protect the bore of the barrel of a firearm against the effect of the exposed projectile material (for instance lead), by providing the cartridge with an outer surface of, e.g., a copper alloy, thereby minimising coating problems resulting from direct contact between the core of the projectile and the wall of the bore and/or the bore rifling, while retaining the advantages relating to a high density of the projectile core (lead).

However, it has been realised in recent years that it may be fitting to avoid the use of lead in projectiles for rifle ammunition, revolver ammunition, etc., for environmental reasons, particularly when the ammunition shall be used on a practice range, and also when the ammunition is used for hunting purposes.

SUMMARY OF THE INVENTION

Consequently, there have been proposed in recent years projectiles that consist of a less environmentally harmful material, such as steel for instance. It is also known in this respect to produce the projectile body from a sintered metal powder. One problem with many such projectile materials, however, is that they can coat, scratch and/or damage the s of the bore in other ways. Because of this, it is known, e.g., from EP-A-0 626 557, to underdimension the actual projectile body in relation to the bore of the firearm and to produce the actual projectile body of sintered metal powder with a plastic covering whose thickness is preferably greater than the penetration depth of the bore rifling, so that the surface of the actual projectile body whose material (iron) is liable to scratch or score the barrel will not come into contact with the wall of the bore. This known solution requires, among other thigs, an additional manufacturing stage, i.e. a stage in which the sintered metal powder body is covered with plastic. In order to achieve good firing precision, i.e. a coherent hit pattern when using such projectiles, it is necessary for the plastic covering to be uniform and even on all projectiles. This is difficult to achieve with a plastic outer covering when applying known technology. Furthermore, if the plastic tends to coat the walls of the barrel, problems can occur with respect to precision.

It is also known to produce projectiles from copper or a copper alloy of full density. The advantages obtained in this regard that the material is considered environmentally friendly, has a relatively high density, a high toughness and a relatively low hardness, therewith enabling the copper projectile to be provided with a hollow tip, so that it can be used for hunting purposes and therewith expand upon impact.

One problem with the use of such copper projectiles or copper-alloy projectiles of fall density, however, is that the material has been found to be relatively hard despite everything else, and that the tolerance region for the engagement between projectiles of a given nominal calibre and the tolerance region for the bores of the weapons concerned can overlap each other to such an extent as to cause the gas pressure in the weapon to become unacceptably high and therewith promote the risk of the barrel bursting when using such copper projectiles. Furthermore, the precision of the weapon suffers when the gas pressure varies.

According to the present invention, this problem can be avoided without needing to reduce the diameter of the metallic part of the projectile and to coat the projectile with a plastic cover, by designing the projectile to include a body of sintered metal powder that faces towards the rifling in the bore of a firearm and therewith co-acts with the rifling, at least the outer surface of the body deformed by the rifling having a porosity in the range of 5–25%.

Further embodiments of the inventive projective are set forth in the accompanying dependent Claims.

In accordance with the invention, the sintered metal powder body of the projectile has a porosity such as to enable the body to be compressed radially with relatively slight resistance during passage of the projectile through the barrel of the weapon if the interference/tolerances require such compression, so that potentially dangerous radial interference between the bore of the barrel and the projectile can be reduced or avoided by the ensuing reduction or elimination of said porosity. Because this radial compaction of a projectile having such porosity can be effected with a lower force than if the projectile should comprise the same material but with fill density, it is possible to restrict friction of the projectile through the bore of the barrel and therewith also the gas pressure in the weapon.

In particular, when the body of the projectile is comprised of copper or a copper alloy, the sintered projectile body may have a porosity in the order of 10%. or generally between 5 and 25%. The projectile may conveniently comprise 90–95% by weight copper and 5–10% by weight zinc and/or tin, preferably about 95% by weight copper and 5% by weight zinc/tin. This minimises coating of the walls of the bore.

This porosity can be readily achieved by producing the projectile with the aid of a conventional sintering technique, wherewith a powder is compacted to form a body of desired shape and of desired dimensions and also with the desired porosity, and thereafter sintering the compacted powder body to desired mechanical strength, for instance to an extent such that the projectile material will have essentially full toughness. It is possible also in this way to obtain the advantage whereby the projectile will not normally splinter upon impact This enables the projectile to be formed to "cushion-up" upon impact, therewith enabling the projectile to be used for hunting purposes with a fully satisfactory result Furthermore, the projectiles can be easily collected from, e.g., the sand used in the construction of a practice firing range and reused when they are still substantially in one piece after striking the embankment on the firing range. It will be understood, however, that the invention also includes projectiles that splinter either completely or particulary upon impact with a target surface, which may be desirable in respect of, e.g., practice ammunition so that penetration of the projectile can be reduced. Particularly when the projectile shall be used as practice ammunition, a major volumetric part of the projectile may be produced from a metal powder, e.g., iron or steel, which results in lower costs.

Naturally, the inventive projectile can be further developed within the scope of the invention. For instance, the projectile may be given a core of some other material, for instance hardmetal, or a heavy material, such as tungsten, in order to give the projectile a relatively high density and/or certain determined ballistic properties.

In one embodiment of the invention, the projectile core can be formed from a material of full density. In another embodiment, the core can be formed from a powder different to its peripheral parts, wherewith the core powder may optionally be compacted, for instance in an axially exposed cavity in that part of the projectile that forms said outer parts. Similarly, the powder composition of the projectile may be varied along the longitudinal axis thereof.

It is important that the projectile has an outer layer of porous material, for instance tin or a tin alloy, that can be compacted radially essentially by eliminating or reducing said porosity as the projectile passes through the bore of the barrel, even in the case of troublesome tolerance overlap, so as to enable the projectile body to be made from a material which in a solid design would cause damage to the bore wall, for instance due to harness, or would be liable to promote a hazardous gas pressure in the weapon. In this regard, the material may also be chosen so as not to coat the lands of the rifling in the barrel, or only to a very small extent.

The inventive porosity of the projectile, at least in its radially outer parts, also enables the use of powder material which in addition to including a relatively large proportion of relatively soft basic material (copper, copper alloy) also contains a minor proportion of hard particles which can be pressed back into the porous, relatively soft material layer upon temporary contact with the wall of the bore.

When the projectile is formed from copper or alloys that have mechanical strength properties similar to those of copper and copper alloys, and densities in the same order of magnitude as that of copper, the porosity of the projectile may be in the region of 5–25%, preferably about 10%. On the one hand, the porosity of the projectile shall be sufficiently high to enable the projectile to be compacted radially with resistance, particularly its radially outer parts upon interference between the projectile and the wall of the barrel. On the other hand, the porosity of the projectile shall be so small that the decrease in density of the projectile due to the porosity will be as small as possible.

By way of example, it can be assumed that the projectile has a solid, completely rigid core with a porous outer layer that contacts the wall of the bore directly and engages the rifling of the barrel, in which case the thickness of the porous outer covering of the projectile will preferably be such that the radial compaction of the projectile required to avoid the generation of hazardous gas pressures can be achieved by elimination of said porosity.

The projectile can be produced from a unitary powder alloy that is compacted to form the projectile body, which is then sintered and preferably pressed to the desired calibration.

However, it may be desirable in some instances to form the projectile from two or more pre-manufactured complementary projectile parts which are joined and connected, preferably by pressing and suitably in conjunction with a calibration pressing process. These parts may have different compositions/alloying, such as to provide the projectile with a bore co-acting outer covering that has the aforementioned advantageous properties, namely a relatively high density, a radial compressiveness that is reduced by said porosity, a material selection that results in minimum coating of steel bore surfaces. The remaining parts of the projectile that do not thus co-act with the rifling of the bore, can be selected to impart other desired properties to the projectile. For instance, said other body parts may be comprised of tungsten or tungsten alloys when a high density is desired. When desiring a low cost, iron powder can be used, which also has a relatively high density. Bismuth and tin are also conceivable materials that result in a relatively low load on the environment.

In other respects, the manufacturing process is the same as that applied conventionally in the manufacture of metal objects by metal powder sintering techniques, wherewith the powder is conventionally compacted in a cold state to a desired body shape, whereafter said body is sintered at a temperature chosen to promote desired mechanical strength properties. If desired, the sintered body can be subjected to a calibration pressing process to give the body a more precise outer shape.

The inventive projectile is conveniently produced from a powder that consists manly of a copper alloy, for instance 95% by weight copper and 5% by weight zinc. Such an alloy has been found particularly favourable with respect to minimum coating of the bore surfaces. The powder may also include minor proportions of another powder that imparts other properties to the projectile, for instance a higher density. Even though such hard particles imply, per se, a scratching or scoring risk or the risk of elevated bore wear, the invention affords the advantage that the porosity of the body enables the hard particles to be pressed down more easily into the more resilient parts of the sintered body.

The inventive projectile may, for instance, be produced in calibre of up to 0.5 inch in diameter (heavy machine gun) or 20 mm in diameter (automatic canon), wherein the choice of material and porosity may also be used to limit the firing range of the weapon, which may be beneficial in conjunction with firing practice.

DETAILED DESCRIPTION OF THE PREFERRED EMBODIMENTS

Figure 1:
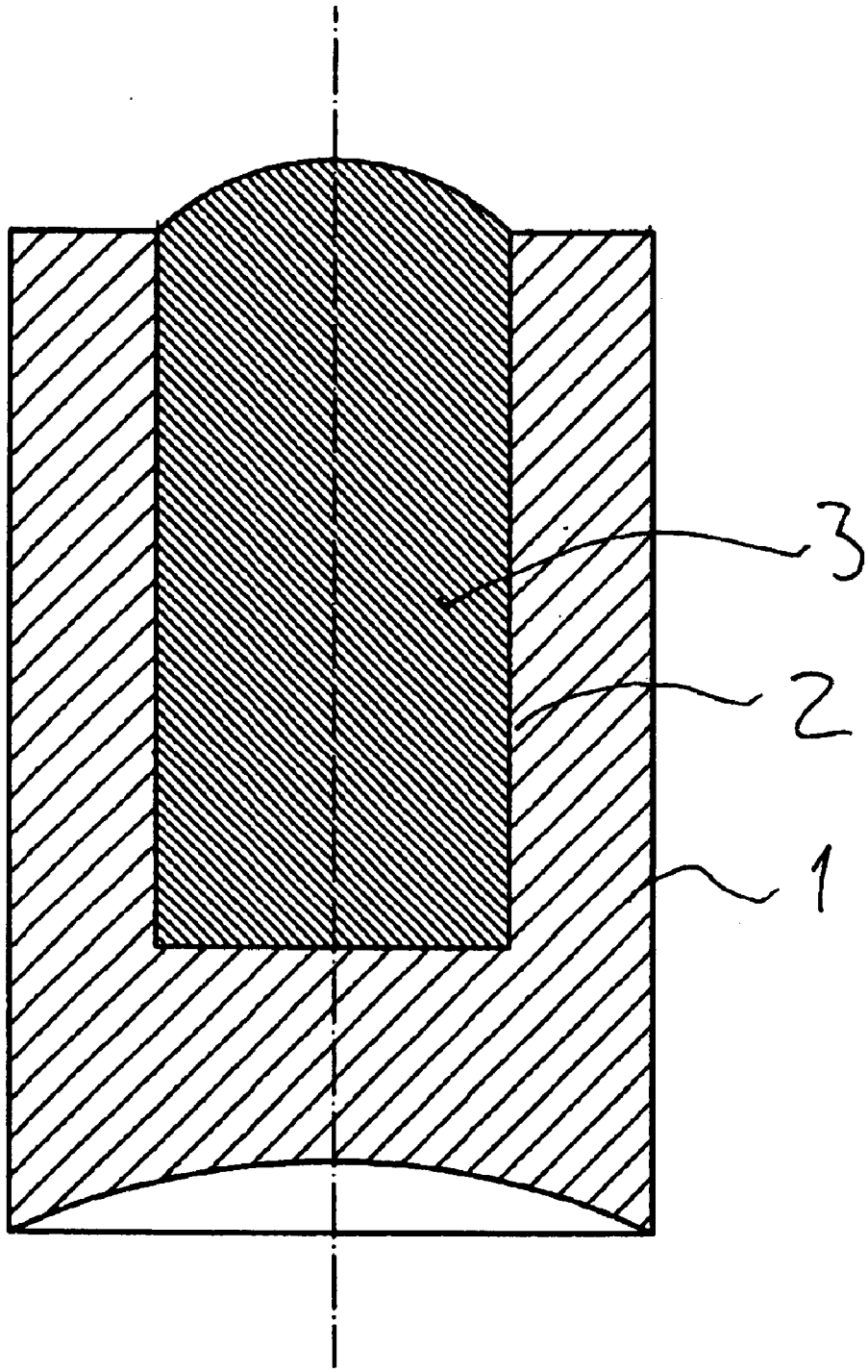
FIG. 1 is an axial section view of an inventive projectile.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The projectile shown in FIG. 1 includes a primary body 1 whose outer cylindrical surface is intended to enable the projectile to engage the helical rifling in the bore of a gun.

The illustrated projectile includes a primary body 1 that has a central, preferably co-axial and rotationally-symmetrical recess 2 in one end thereof, preferably its front end. A core 3 is fastened stably in the recess 2 and conveniently has a recess-complementary shape. The body 1 is comprised of an alloy of Cu (90–95% by weight) and Zn (the remainder), and has a porosity of 10%. The core 3 does not contact the rifling of the bore and may be comprised of material that fulfils desired requirements, for instance low cost, brittleness, density, manufacturing costs, and environmentally friendliness and the like. The core 3 of the illustrated embodiment may be formed by a sintered metal powder body, for instance a body comprised of iron powder. The core 3 and the body 1 can include particles of a foreign material, for instance heavy particles that serve to increase the density of the body/core. FIG. 1 shows by way of example a so-called W. C. bullet, calibre 38, that has a diameter of 9.07 mm for correct co-action with the rifling of a corresponding bore in respect of a 38 calibre firearm.

The recess 2 in said body defines a wall thickness of about 2 mm for the front pan of the body 1. The depth of the recess is about 10 mm. The total length of the body 1 is about 14 mm.

The core 3 may alternatively have a porosity of 10% by volume for example. The core 3 may be formed by cold compaction of a metal powder in a mould. The compacted, moulded core may then be sintered to obtain desired mechanical strength properties.

The body 1 is produced from a powder comprised of the aforesaid alloy, this powder being cold compacted in a mould and the compacted powder body then sintered to impart desired properties thereto. The body has a porosity of about 10%.

The core is then inserted into the recess in said body and the body and core then subjected to a calibration pressing process that imparts well-determined outer cross-sectional dimensions to the resultant projectile on the one hand, and secures the core in the body recess 2 on the other hand. The core can be diversified so that it can be deformed by the rifling in the bore of the barrel with the deformation resulting in a fragile or brittle core.

The diameter of the recess in the body 1 is made slightly larger than the diameter of the core, so that the core can be easily inserted into the recess prior to the calibration pressing process, if this process is able to deform the body 1 into securing contact with the core.

In one embodiment of an inventive projectile (not shown) which is assumed to be the most common, a powder comprised of Cu—Zn alloy (95 and 5% by weight) is compacted in a mould to form a pressed body that is later sintered. The moulding and sintering conditions are chosen so that the sintered body will be somewhat overdimensioned in respect to desired final dimensions. After sintering the body, and preferably after cooling said body, the sintered projectile body is calibration pressed to impart a desired outer dimension, i.e. to eliminate shape deviations resulting from the sintering process.

The powder and the working operations are chosen to give the projectile a final porosity of about 10%, at least in its outer layer. The projectile is given standard calibre dimensions, so that its outer layer will engage with the helical rifling the barrel, and therewith impart the correct rotation and guidance to the projectile.

EXAMPLE

A projectile of 30 calibre (diameter about 7.6 mm) produced in accordance with the invention on the basis of powder comprising Cu—Zn alloy (95% by weight Cu, 5% by weight Zn) was manufactured by compacting a powder mass at a pressure of 6000 bar, to form a shaped body having a porosity of about 10%. The shape of the body conformed essentially with the desired shape of the projectile, and was sintered at a temperance of 1000–1050° C. under a shielding gas for 33 minutes (30–40 min.). After cooling, the projectile was calibration pressed at 6000 bar to its final shape, said projectile then having a porosity of 10%. The hardness of the projectile was measured as being 80% of the hardness of a solid projectile comprised of said alloy.

In practical embodiments, at least the porous sintered outer layer of the projectile may include a significant proportion of a metal, such as copper for instance, that preferably has a lubricating function against the bore wall, for instance a steel wall. This metal (copper) proportion will correspond at least to 10% by weight and preferably 20% by weight A projectile intended, for example, for practice firing on a firing range may, for instance, comprise in at least its outer cylindrical layer a porous, sintered powder mixture that consists of a further 20% by weight copper granules and 80% by weight granules of another substance, for instance a metal or a metal alloy such as steel, whose granules or are covered with copper.

Projectiles whose porous outer cylindrical layers contain at least 50% by weight copper are preferred.

In another feasible embodiment, at least the porous, sintered outer cylindrical layer of the projectile may consist of tin bronze that preferably contains at least 80% by weight copper and the remainder essentially tin, preferably about 90% by weight copper and the remainder tin.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A projectile comprising a body of sintered metal powder having at least an outer surface of sintered metal powder that faces towards rifling in a bore of a firearm and co-acts with said rifling to be deformed thereby, said outer surface having a porosity in a range of 5–25%.

2. The projectile as set forth in claim 1, wherein all of said body is made of sintered metal powder of a substantially uniform composition.

3. The projectile as set forth in claim 1, wherein said powder consists essentially of copper or copper alloy.

4. The projectile as set forth in claim 1, wherein the body includes a cavity which is filled with a filling of a material other than a material of said body.

5. The projectile as set forth in claim 4, wherein the filling is made of sintered metal powder of a composition other than a composition of the body co-acting with said rifling, said body and said filling being complementary in shape and joined by deformation bonding.

6. The projectile as set forth in claim 4, wherein the body has a radial thickness of such magnitude as to permit radial interference between the projectile and the rifling in the bore of the firearm to be accommodated to a substantial extent by the porosity of said body upon passage of the projectile through the bore of the firearm.

7. The projectile as set forth in claim 6, wherein the body layer co-acting with said rifling has a thickness of at least 0.2 mm.

8. The projectile as set forth in claim 6, wherein the body layer co-acting with said rifling has a thickness of at least 0.4 mm.

9. The projectile as set forth in claim 3, wherein the metal powder essentially at least 85% by weight of copper, a remainder being made of at least one of tin and zinc.

10. The projectile as set forth in claim 9, wherein the body is comprised essentially of a sintered powder mass including a copper-zinc alloy that contains at least 90% copper by weight.

11. The projectile as set forth in claim 1, wherein the body has a porosity in a range of 7–17%.

12. The projectile as set forth in claim 1, wherein the body has a porosity of about 10%.

* * * * *